US008113676B2

(12) United States Patent
Hallowell

(10) Patent No.: US 8,113,676 B2
(45) Date of Patent: Feb. 14, 2012

(54) ILLUMINATED BOOK MARK

(76) Inventor: Mark Hallowell, Westfield, IN (US)

( * ) Notice: Subject to any disclaimer, the term of this patent is extended or adjusted under 35 U.S.C. 154(b) by 400 days.

(21) Appl. No.: 12/474,263

(22) Filed: May 28, 2009

(65) Prior Publication Data

US 2010/0302759 A1 Dec. 2, 2010

(51) Int. Cl.
*F21V 14/00* (2006.01)
*F21K 2/06* (2006.01)

(52) U.S. Cl. ..... 362/99; 362/34; 362/98; 362/276

(58) Field of Classification Search ..... 362/34, 362/98, 99, 311.06, 311.01, 276, 253, 396, 362/394, 411, 295; 40/341, 352, 356, 353, 40/661.02

See application file for complete search history.

(56) References Cited

U.S. PATENT DOCUMENTS

| | | | | | |
|---|---|---|---|---|---|
| 2,358,203 | A * | 9/1944 | Best | 362/604 |
| 3,500,034 | A * | 3/1970 | Bissell | 362/98 |
| 3,781,536 | A * | 12/1973 | Naeseth et al. | 362/34 |
| 4,184,193 | A * | 1/1980 | Heffernan et al. | 362/34 |
| 4,751,615 | A * | 6/1988 | Abrams | 362/604 |
| 5,027,261 | A * | 6/1991 | Hudson, Jr. | 362/98 |
| 5,226,710 | A * | 7/1993 | Giglia et al. | 362/34 |
| 5,280,415 | A * | 1/1994 | Barnette | 362/99 |
| 5,381,310 | A * | 1/1995 | Brotz | 362/556 |
| 5,502,623 | A * | 3/1996 | Brotz | 362/99 |
| 5,557,869 | A * | 9/1996 | Douglas | 40/542 |
| 6,951,403 | B2 * | 10/2005 | Bennett, Jr. | 362/98 |
| 7,178,928 | B2 * | 2/2007 | Tsai | 362/98 |
| 7,920,320 | B2 * | 4/2011 | Watson et al. | 359/296 |

* cited by examiner

*Primary Examiner* — Bao Q Truong

(74) *Attorney, Agent, or Firm* — Brannon Robinson Sowers Hughel & Doss PC; C. John Brannon

(57) ABSTRACT

A device for discreetly illuminating theater programs for reading in a darkened theater, including an elongated generally flat top surface portion having a proximal end and a distal end and a first width and defining a display surface, an elongated generally flat bottom surface portion spaced from the generally flat elongated top surface portion and extending generally parallel to the elongated generally flat top surface portion and having a second width less than the first width, a first side portion extending between the generally flat top and bottom surface portions and disposed substantially perpendicular to the generally flat top and bottom surface portions, a second side portion extending between the generally flat top and bottom surface portions, wherein the generally flat top and bottom surface portions and the first and second side portions define a housing, a generally cylindrical recess formed in the housing, a translucent elongated slit formed in the second side portion and directed away from the elongated generally flat top surface portion, and a light source disposed in the generally cylindrical recess. Activation of the light source shines light through the slit.

8 Claims, 2 Drawing Sheets

ILLUMINATED BOOK MARK

TECHNICAL FIELD

This novel technology relates to advertising media and, more particularly, to a generally flat, elongated member having an advertising banner display surface and also including a portable, temporary light source for reading theatrical programs or playbills after the house lights have been dimmed.

BACKGROUND

Bookmarks are elongated, typically thin members insertible between the pages of a book or magazine to make a particular page easy to find. Bookmarks are typically used to mark the page where the reader left off such that the reader may quickly return thereto.

Bookmarks, like books, work best in a well-lit environment. In dark environments, a reader may opt to use a portable reading light. A variety of portable reading lights are known, most of which are battery powered attach to either the book or to the reader to shine sufficient light onto a book face to allow the reader to read. However, these portable lights are inappropriate for dark environments such as theaters, as they tend to distract surrounding theater patrons, as well as on-stage performers.

There is thus a need for a portable illumination device that can enable a theater patron to read theatrical materials, such as programs and/or playbills in a darkened theater, such as during a performance, without distracting surrounding theater patrons. The present novel technology addresses this need.

SUMMARY

The present novel technology relates to method and apparatus for reading a theater program during a performance in a darkened theater without otherwise distracting the surrounding theater patrons. One object of the present novel technology is to provide an improved portable reading light. Related objects and advantages of the present novel technology will be apparent from the following description.

DESCRIPTION OF THE PREFERRED EMBODIMENTS

Figure 1:
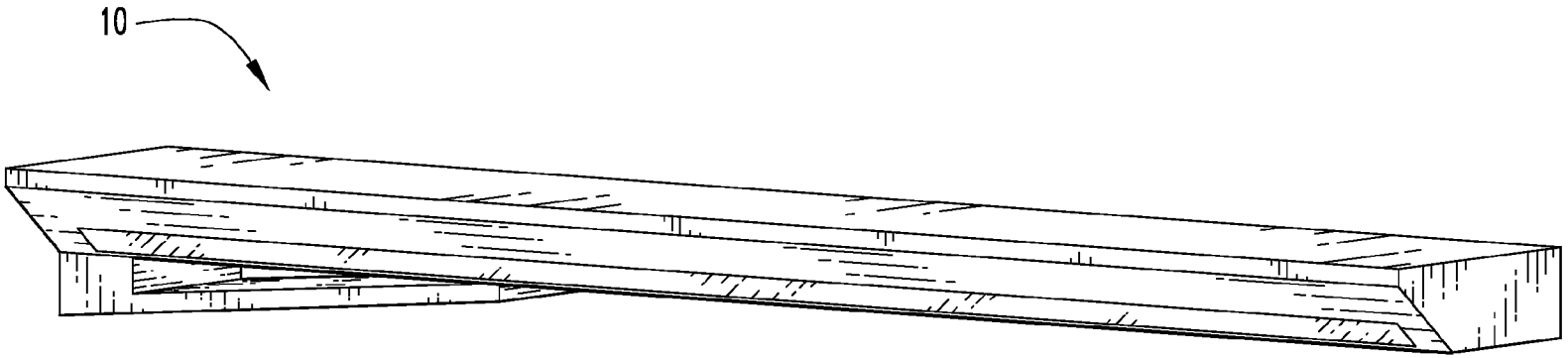
FIG. 1 is a perspective view of a first embodiment illuminatable book mark of the present novel technology.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

Figure 2A:
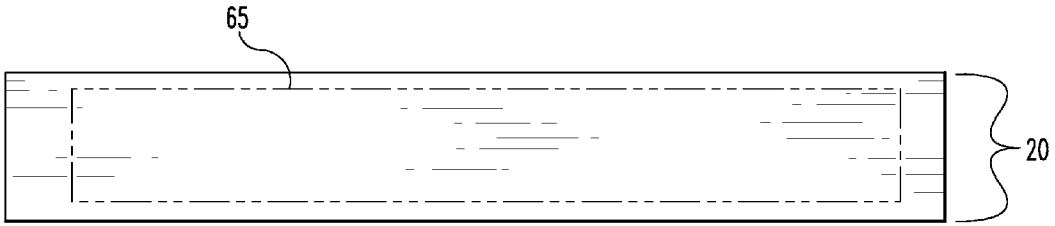
FIG. 2A is top plan view of the embodiment of FIG. 1.
Figure 2B:
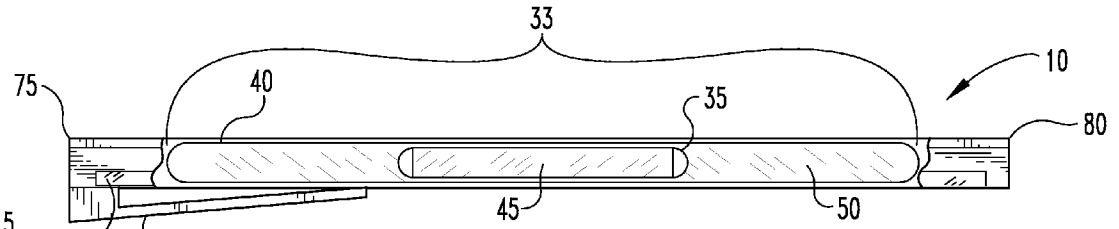
FIG. 2B is side elevational view of the embodiment of FIG. 1
Figure 2C:
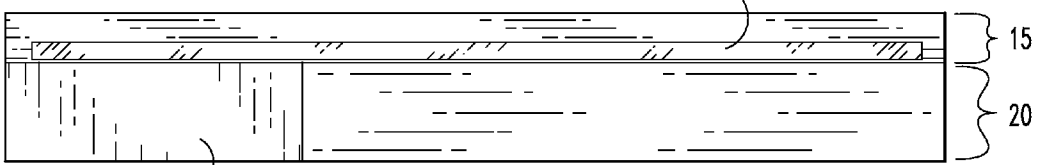
FIG. 2C is a bottom plan view of the embodiment of FIG. 1.
Figure 2D:
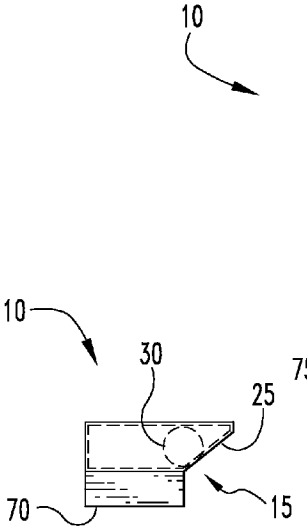
FIG. 2D is a proximal end elevational view of the embodiment of FIG. 1.

FIGS. 1-2D relate to a first embodiment of the present novel technology, a light emitting member 10 having a generally elongated light generating portion 15 and a generally flat elongated portion 20 extending therefrom. The light emitting member 10 is typically made of a flexible material, such as plastic, although any convenient composition may be selected. The light generating portion 15 typically includes a generally elongated, typically flexible, housing portion 25 with a typically cylindrical or tubular recess 30 formed therein, into which is inserted a light source 33. In this embodiment, the light source 33 includes first and second capsules 35, 40 which may be respectively filled with first and second components 45, 50 of a binary light emitting chemical composition. Typically, the first capsule 35 is made of glass, hard plastic or the like and positioned within the second capsule 40. The second capsule 40 is typically moderately flexible, such that if the housing 25 and capsules 35, 40 are sufficiently flexed or bent, the first capsule 40 ruptures, allowing the first and second components 45, 50 to mix to yield a light emitting binary compound substantially filling the recess 30. Alternately, the first and second capsules 35, 40 may both be made of a breakable material and positioned within a larger chamber, such that flexure of the housing 25 may break both capsules 35, 40 to mix the components 45, 50. Typically, the light emitting binary substance has an effective life of several hours.

For example, first and second components 45, 50 may be, respectively, hydrogen peroxide solution and a solution including phenyl oxalate ester and a fluorescent dye. When the two solutions are combined, the hydrogen peroxide oxidizes the phenyl oxalate ester, resulting in a phenol and an unstable peroxyacid ester. The unstable peroxyacid ester decomposes, resulting in additional phenol and a cyclic peroxy compound. The cyclic peroxy compound decomposes to carbon dioxide, releasing energy to the dye which allows electrons in the dye atoms to temporarily jump to a higher level. When the electrons return to their original, stable orbitals, they release energy in the form of visible light.

Typically, an elongated translucent or transparent window slit 60 is formed through the side of the housing 25 to direct light generated by the binary chemical compound beyond the housing 25 and onto reading matter, such as a theatre program or playbill. The dimensions and transmission properties of the slit 60 are selected such that a predetermined amount of light generated in the recess 30 may shine through the slit 60. More typically, the light generation characteristics of the binary composition and the dimensions and transmission properties of the slit 60 are chosen such that the light provided by the slit is sufficient for reading in a darkened environment, such as a theater during a show, but is not so bright or intense that it is a nuisance to others, such as the surrounding theater patrons.

The generally flat elongated portion 20 has a receiving surface 65 that may typically support messages and/or images, such as advertising copy, sponsorship information, company trademarks and/or logos, and the like. In this particular embodiment, the generally flat elongated portion 20 is opaque to light generated in the recess 30, but in other embodiments the receiving surface 65 may be at least partially translucent, such that any advertising messages or images displayed thereupon may be backlit.

A clip portion 70 typically extends from the light emitting member 10, typically extending from a surface opposite the receiving surface 65 and adjacent the slit 60. The clip portion 70 is typically an L-shaped member extending from the proximal end 75 of the light emitting member 10 and extends toward the opposite, distal end 80. The clip portion 70 typically extends back towards the generally flat elongated portion 20, although it may extend parallel thereto.

In this embodiment, the light generated by the light source 33 is substantially white in color, although different dyes may be added to yield different colors. Likewise, the optical slit 60 may be tinted to further restrict the color of the light shining therethrough. The light emerging from the light source 33 and or optical slit 60 is typically red, but may be any desired color.

In operation, the apparatus 10 may be used for discretely illuminating and reading a theater program in a darkened theater during a production or like environment by first locating the apparatus 10, defined by a generally flat elongated housing portion 25 for containing and directing a light source 33, wherein the housing portion 25 defines a substantially flat top portion 20, a light source 33 disposed within the housing portion 25, and an optical slit 60 formed through the housing portion 25 for directing light from within the housing 25 in a direction away from the substantially flat top portion 20, and then actuating the light source 33 to produce light. In the case of a binary chemical light source 33, such actuation is accomplished by bending or twisting the apparatus body 10 until an inner compartment 35 breaks to release the binary chemical components for mixing. The apparatus 10 is placed adjacent a page to be read and light shines through the slit 60 onto the page to be read. Once illuminated, the page may be read.

Typically, the light shining through the slit 60 is limited by the slit 60 and the nature of the light source 33 to an apparent intensity or luminous emittance of about 20 lux. More typically, the light shining through the slit 60 is limited by the slit 60 and the nature of the light source 33 to an apparent intensity/luminous emittance of about 10 lux, still more typically to about 5 lux and yet more typically to about 2 lux.

Figure 3:
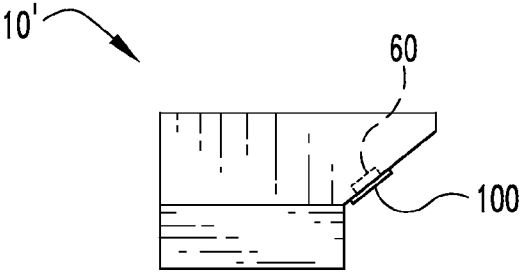
FIG. 3 is a perspective view of a second embodiment illuminatable book mark.

In one alternate embodiment light emitting member 10', the slit 60 is of variable dimension, such as having a movable shade member 100 or the like operationally connected thereto (see FIG. 3). In another alternate embodiment the light source 33 is an electric bulb disposed in the recess 33 with a battery likewise disposed in or adjacent to the recess 33.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected

What is claimed is:

1. A device for discreetly illuminating theater programs for reading in a darkened theater, comprising in combination:

an elongated generally flat top surface portion having a proximal end and a distal end and a first width and defining a display surface;

an elongated generally flat bottom surface portion spaced from the generally flat elongated top surface portion and extending generally parallel to the elongated generally flat top surface portion and having a second width less than the first width;

a first side portion extending between the generally flat top and bottom surface portions and disposed substantially perpendicular to the generally flat top and bottom surface portions;

a second side portion extending between the generally flat top and bottom surface portions, wherein the generally flat top and bottom surface portions and the first and second side portions define a housing;

a generally cylindrical recess formed in the housing;

a translucent elongated slit formed in the second side portion and directed away from the elongated generally flat top surface portion; and a light source disposed in the generally cylindrical recess;

wherein activation of the light source shines light through the slit.

2. The device of claim 1 wherein the light source is a chemical light stick.

3. The device of claim 1 wherein flexing the housing activates the light source.

4. The device of claim 1 and further including a clip member connected to the housing and extending parallel to the elongated generally flat bottom surface portion.

5. The device of claim 1 and further including advertising media operationally connected to the elongated generally flat top surface portion.

6. The device of claim 5 wherein when the light source is activated, the advertising media are backlit.

7. The device of claim 1 and further including a movable cover operationally connected to the housing for at least partially closing the slit to light passing therethrough.

8. A system for reading a theater program in a darkened theater during a production, comprising in combination:

a) locating an apparatus for discretely illuminating a portion of a page in a relatively dark environment, wherein the apparatus includes:

a generally flat elongated housing portion for containing and directing a light source, wherein the housing portion defines a substantially flat top portion;

a light source disposed within the housing portion; and an optical slit formed through the housing portion for directing light from within the housing in a direction away from the substantially flat top portion;

b) actuating the light source to produce light;

c) placing the apparatus adjacent a page to be read;

d) shining light through the slit onto the page to be read; and e) reading the page;

wherein the light shining through the slit is sufficient to read the page by substantially insufficient to distract neighboring theater audience members; and wherein the apparatus is actuated by bending the housing.

* * * * *